US010029293B2

(12) United States Patent
Fujii et al.

(10) Patent No.: US 10,029,293 B2
(45) Date of Patent: Jul. 24, 2018

(54) METHOD FOR MANUFACTURING METAL COMPONENT WITH THREE-DIMENSIONAL EDGE AND DIE SETS FOR MANUFACTURING THE SAME

(71) Applicant: JFE STEEL CORPORATION, Tokyo (JP)

(72) Inventors: Yusuke Fujii, Fukuyama (JP); Toyohisa Shinmiya, Fukuyama (JP); Kinya Nakagawa, Fukuyama (JP); Yuji Yamasaki, Fukuyama (JP); Katsuhiro Ochi, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 164 days.

(21) Appl. No.: 14/762,372

(22) PCT Filed: Jan. 20, 2014

(86) PCT No.: PCT/JP2014/000241
§ 371 (c)(1),
(2) Date: Jul. 21, 2015

(87) PCT Pub. No.: WO2014/112391
PCT Pub. Date: Jul. 24, 2014

(65) Prior Publication Data

US 2015/0360272 A1 Dec. 17, 2015

(30) Foreign Application Priority Data

Jan. 21, 2013 (JP) ..... 2013-008001
Jan. 21, 2013 (JP) ..... 2013-008002

(51) Int. Cl.
*B21D 22/02* (2006.01)
*B21D 22/26* (2006.01)
*B21D 5/01* (2006.01)

(52) U.S. Cl.
CPC ..... *B21D 22/02* (2013.01); *B21D 5/01* (2013.01); *B21D 22/26* (2013.01)

(58) Field of Classification Search
CPC . B21D 5/01; B21D 5/06; B21D 7/022; B21D 7/08; B21D 22/02; B21D 22/06; B21D 11/02; B21D 22/26
See application file for complete search history.

(56) References Cited

U.S. PATENT DOCUMENTS 8,505,941 B2 * 8/2013 Hashimoto ..... B21D 9/15 72/369
2010/0279842 A1 11/2010 Epps

FOREIGN PATENT DOCUMENTS

GB 2444574 A 6/2008
JP 56045219 A * 4/1981
(Continued)

OTHER PUBLICATIONS

EPO machine translation of JP 56045219 A.*
(Continued)

*Primary Examiner* — R. K. Arundale
*Assistant Examiner* — Pradeep C Battula
(74) *Attorney, Agent, or Firm* — Oliff PLC

(57) ABSTRACT

A method and die set for manufacturing a metal component with a three-dimensional edge from a blank as a raw material. The blank is cut from a metal sheet and has a curve-shaped curved edge portion with two ends. The method includes providing a bend formation line and forming the three-dimensional shape using a first die and a second die.

6 Claims, 11 Drawing Sheets

(56) References Cited

FOREIGN PATENT DOCUMENTS

| | | | | |
|---|---|---|---|---|
| JP | H03-169436 | A | 7/1991 | |
| JP | 2006-289480 | A | 10/2006 | |
| JP | 2006-305627 | A | 11/2006 | |
| JP | 2009-241109 | A | 10/2009 | |
| JP | 2010-005651 | A | 1/2010 | |
| JP | 2010-227995 | A | 10/2010 | |
| WO | WO 2010114173 | A1 * | 10/2010 | ..... B21D 9/15 |

OTHER PUBLICATIONS

Apr. 15, 2014 International Search Report issued in International Application No. PCT/JP2014/000241.
Feb. 3, 2016 Office Action issued in Chinese Application No. 201480005381.0.

* cited by examiner

A–A'

METHOD FOR MANUFACTURING METAL COMPONENT WITH THREE-DIMENSIONAL EDGE AND DIE SETS FOR MANUFACTURING THE SAME

TECHNICAL FIELD

This application is directed to a method for manufacturing a metal component with a three-dimensional edge and die sets for manufacturing the metal component with a three-dimensional edge, and in particular, relates to a method for manufacturing the metal component with a three-dimensional edge and die sets used to manufacture the metal component with a three-dimensional edge for manufacturing the metal component with a three-dimensional edge by press forming in which a curve-shaped edge portion provided in a blank formed of a metal sheet (for example, a high-strength steel sheet having a tensile strength (TS) of 590 MPa or more), or further, the curve-shaped edge portion and part of the blank adjacent to the curve-shaped edge portion are processed into a three-dimensional shape by forming.

Here, the three-dimensional shape of the three-dimensional edge refers to a three-dimensional shape that is a vertical wall, a chevron shape, or a shape in which one of these shapes is continuous with the other. The blank refers to a single flat-plate raw material to be formed, is cut from an original sheet, and, when cut from the original sheet, has a planar outline shape corresponding to a formed three-dimensional shape.

BACKGROUND

As means for obtaining a metal component with a curved edge having a three-dimensional structure, for example, a vertical wall, press forming which is a combination of various types of forming including bending, drawing, and stretch flanging is performed on a single metal sheet in the related art (referred to as the related-art press forming hereafter). As methods of obtaining dimensional accuracy, the following methods have been proposed: a method in which a divergent step is provided in a vertical wall portion (Patent Literature 1); and a method in which a flange portion is formed in two steps (Patent Literature 2). As methods of preventing torsion, the following methods have been proposed: a method in which bending is performed in two steps (Patent Literature 3); and a method of applying stress to a vertical wall portion (Patent Literature 4).

CITATION LIST

Patent Literature

PTL 1: Japanese Unexamined Patent Application Publication No. 2010-5651

PTL 2: Japanese Unexamined Patent Application Publication No. 2006-289480

PTL 3: Japanese Unexamined Patent Application Publication No. 2009-241109

PTL 4: Japanese Unexamined Patent Application Publication No. 2006-305627

SUMMARY

Technical Problem

An increase of the strength of steel sheets corresponding to a demand for weight reduction at the same time invites reduction of drawing property, bulging property, and stretch flange formability of steel sheets. In the case where a blank of a high-strength steel sheet is formed so as to manufacture a component with an edge having a three-dimensional structure, for example, a vertical wall, the vertical wall can be formed by bending when the edge portion is straight. However, when formation of the vertical wall is attempted by ordinary press forming (stretch flanging or drawing) in an edge portion having a curved shape, the line length of a boundary curve on a blank edge side is different from that on a bent portion side in an edge region to be processed into the vertical wall. Thus, when stretch flanging is performed, cracking occurs, and when drawing is performed, wrinkling occurs. At this time, by optimizing forming conditions such as blank holding or changing the shape of the component, the occurrences of cracking and wrinkling can be suppressed to some degree. However, with such methods, it can be said that there is a limit in addressing a further increase in strength such as TS of 980 MPa or more for satisfying the demand for weight reduction.

Furthermore, problems such as an increase in manufacturing steps and reduction in yields arise in any of the methods such as forming in two steps, providing the step in the vertical wall portion, and the applying stress to the vertical wall portion. Furthermore, the cracking and wrinkling of the vertical wall are caused by the difference in the line length between the boundary curve on the blank side and the boundary curve on the bent portion side in the edge region to be processed into the vertical wall. Thus, countermeasure against cracking and wrinkling is not provided.

That is, particularly in such a case where the blank is formed of a high-strength steel sheet, using related-art die sets for press forming to manufacture a metal component with a three-dimensional edge having a curved edge portion processed into a three-dimensional shape in a simple process causes cracking and wrinkling to occur. Consequently, a target shape of the metal component with a three-dimensional edge cannot be obtained. Thus, there is a problem in that simplifying the manufacturing process and reducing the weight of the product are very difficult to achieve at the same time.

Solution to Problem

The inventors studied means for solving the above-described problem to arrive at the disclosed embodiments. Since a workpiece is bent with little deformation by drawing, bulging, and stretch flanging, by applying the method of folding to a metal blank, a metal component with a three-dimensional edge without cracks and wrinkles can be manufactured from a high-strength metal blank in an efficient forming process. Furthermore, by suppressing processing of the vertical wall and the bend line into three-dimensional shapes, local deformation can be avoided. Thus, it has been understood that a large region can be processed into a desired three-dimensional shape.

Disclosed embodiments have made in accordance with the above-described finding. This disclosure provides:

(1) A method for manufacturing a metal component with a three-dimensional edge manufactures the metal component with a three-dimensional edge from a blank as a raw material. The blank is cut from a metal sheet and has a curve-shaped curved edge portion having both ends. The curved edge portion, or further, the curved edge portion and part of the blank adjacent to the curved edge portion are processed into a three-dimensional shape by forming. The method includes a step of providing a bend formation line and a step of forming the three-dimensional shape. The step of providing the bend formation line serves as a first step and that provides the bend formation line in the curved edge portion so that a bend radius of a section of a bent portion downwardly or upwardly bent along a curve of the curved edge portion is from 0.5 to 30 mm. The step of forming the three-dimensional shape serves as a second step following the first step, and processes the curved edge portion, or further, the curved edge portion and the part of the blank adjacent to the curved edge portion into the three-dimensional shape from the bend formation line as a start point by moving both end portions of the curved edge portion so as to reduce or increase a distance between both the ends.

(2) In the method for manufacturing the metal component with a three-dimensional edge according to (1), a flat catch portion and a middle portion, which is connected from the catch portion to both ends or an intermediate region of a portion of a main body of the blank where the bend formation line is provided or at least one of a plurality of bend formation lines are provided, are provided.

(3) In the method for manufacturing the metal component with a three-dimensional edge according to (1) or (2), a plurality of the bend formation lines are provided, the plurality of bend formation lines are curved lines, and a portion of at least one of the plurality of curved lines has a larger curvature than curvatures of curved portions continuous with the portion of the at least one of the plurality of curved lines on both sides.

(4) In the method for manufacturing the metal component with a three-dimensional edge according to any one of (1) to (3), in the second step, a vertical wall portion that is adjacent to the curved edge portion and that is processed into the three-dimensional shape is pressed.

(5) In the method for manufacturing the metal component with a three-dimensional edge according to (1) to (4), in the second step, the bend formation line is pressed as the curved edge portion is processed into the three-dimensional shape.

(6) In the method for manufacturing the metal component with a three-dimensional edge according to (1) to (5), in the second step, a shape of the curved edge portion is corrected while the curved edge portion is being processed into the three-dimensional shape or after the curved edge portion has been processed into the three-dimensional shape.

(7) Die sets for manufacturing a metal component with a three-dimensional edge are used when manufacturing the metal component with a three-dimensional edge from a blank as a raw material. The blank is cut from a metal sheet and has a curve-shaped curved edge portion having both ends. The metal component with a three-dimensional edge is manufactured by processing the curved edge portion, or further, the curved edge portion and part of the blank adjacent to the curved edge portion into a three-dimensional shape by forming. The die sets include a first-step die set and a second-step die set. The first-step die set is used for a step of providing a bend formation line to provide the bend formation line in the curved edge portion so that a bend radius of a section of a bent portion downwardly or upwardly bent along a curve of the curved edge portion is from 0.5 to 30 mm. The second-step die set used in the step of forming the three-dimensional shape following the step of providing the bend formation line processes the curved edge portion, or further, the curved edge portion and the part of the blank adjacent to the curved edge portion into the three-dimensional shape from the bend formation line as a start point by moving both end portions of the curved edge portion so as to reduce or increase a distance between both the ends.

(8) In the die sets for manufacturing the metal component with a three-dimensional edge according to (7), the first-step die set provides the blank with a flat catch portion and a middle portion, which is connected from the catch portion to both ends or an intermediate region of a portion of a main body of the blank where the bend formation line is provided or at least one of a plurality of bend formation lines are provided.

(9) With the die sets for manufacturing the metal component with a three-dimensional edge according to (7) or (8), a plurality of the bend formation lines are provided, the plurality of bend formation lines are curved lines, and a portion of at least one of the plurality of curved lines has a larger curvature than curvatures of curved portions continuous with the portion of the at least one of the plurality of curved lines on both sides.

Advantageous Effects

According to embodiments, since the workpiece (material) is bent with little deformation due to drawing, bulging, and stretch flanging, the curved edge portion can be processed into a three-dimensional vertical wall or a three-dimensional chevron shape by forming without the occurrences of cracks and wrinkles. Thus, the metal component with a three-dimensional edge can be manufactured even from a single plate of high-strength steel sheets. Furthermore, since formation with little extension or contraction is possible, a curved edge portion having a small radius of curvature R that cannot be processed into the three-dimensional shape by the related-art forming can be processed into the three-dimensional shape by forming.

BRIEF DESCRIPTION OF THE DRAWINGS

FIG. 1(*b*) includes a schematic view according to a first embodiment;

FIG. 1(*c*) includes a schematic view according to a first embodiment;

FIG. 1(*d*) includes a schematic view according to a first embodiment;

FIG. 2(*b*) includes a schematic view according to a second embodiment;

FIG. 2(*c*) includes a schematic view according to a second embodiment;

FIG. 2(*d*) includes a schematic view according to a second embodiment;

FIG. 3(*b*) includes a schematic view according to a third embodiment;

FIG. 3(*c*) includes a schematic view according to a third embodiment;

FIG. 3(*d*) includes a schematic view according to a third embodiment;

FIG. 4(*b*) includes a schematic view according to a fourth embodiment;

FIG. 4(*c*) includes a schematic view according to a fourth embodiment;

FIG. 4(*d*) includes a schematic view according to a fourth embodiment;

DETAILED DESCRIPTION

Figure 1:
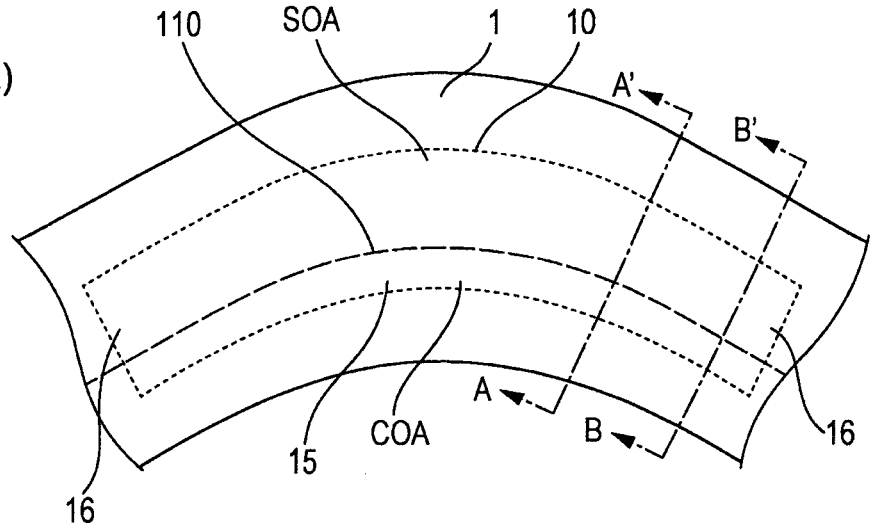
FIG. 1(*a*) includes a schematic view according to a first embodiment.
Figure 1:
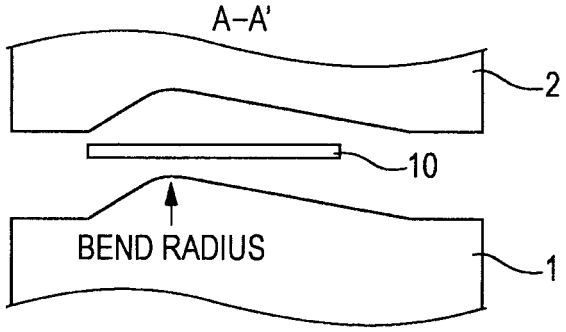
Figure 1:
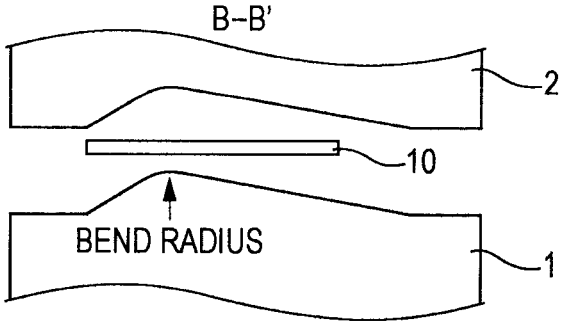
Figure 1:
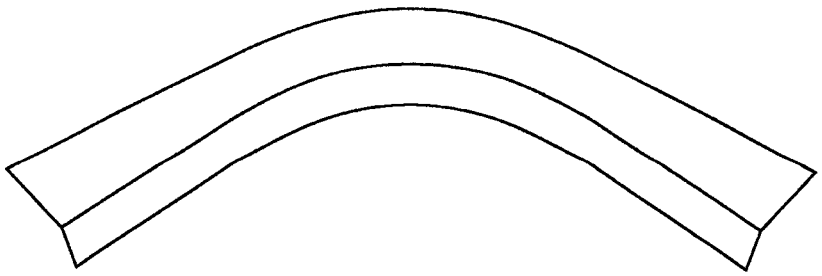

Disclosed embodiments include a method for manufacturing a metal component with a three-dimensional edge and die sets for manufacturing used to manufacture the metal component. The metal component with a three-dimensional edge is formed of a blank as a raw material cut from a metal sheet and having a curve-shaped curved edge portion having both ends. The metal component with a three-dimensional edge is manufactured by processing the curved edge portion, or further, the curved edge portion and part of the blank adjacent to the curved edge portion into a three-dimensional shape by forming.

The method for manufacturing includes a step of providing a bend formation line as a first step and a step of forming the three-dimensional shape as a second step. In the step of providing a bend formation line, a downward or upward bend formation line is provided along a curve of the curved edge portion in the curved edge portion. In the step of forming the three-dimensional shape performed next to the step of providing the bend formation line, the curved edge portion, or further, the curved edge portion and the part of the blank adjacent to the curved edge portion are processed into the three-dimensional shape from the bend formation line as a start point by moving both end portions of the curved edge portion so as to reduce or increase the distance between both the ends. Here, types of the curved line having both the ends include a bend formation line having both ends.

The die sets for manufacturing include a first-step die set and a second-step die set. The first-step die set is used for the step of providing the bend formation line, in which the downward or upward bend formation line is provided along the curve of the curved edge portion in the curved edge portion. The second-step die set is used for the step of forming the three-dimensional shape, which is performed next to the step of providing the bend formation line and in which the curved edge portion, or further, the curved edge portion and the part of the blank adjacent to the curved edge portion are processed into the three-dimensional shape from the bend formation line as the start point by moving both the end portions of the curved edge portion so as to reduce or increase the distance between both the ends. Here, types of the curved line having both the ends include a bend formation line having both ends.

When the bend formation line is provided in the step of providing the bend formation line, both the end portions of the curved edge portion are moved so as to reduce or increase the distance between both the ends in the step of forming the three-dimensional shape, which is performed next to the step of providing the bend formation line. This causes one of both sides of the bend formation line separated by the bend formation line as the border between both the sides to naturally ascend or descend relative to the other because of the difference between the line lengths on both the sides of the bend formation line. This allows and facilitates the processing of the curved edge portion, or further, the curved edge portion and the part of the blank adjacent to the curved edge portion into the three-dimensional shape from the bend formation line as the start point. Without the step of providing the bend formation line, the processing into the three-dimensional shape by the step of forming the three-dimensional shape is very difficult to be performed.

The first-step die set used for the step of providing the bend formation line may be any one of die sets used for forming such as roll forming, sequential forming, hydraulic forming, rubber forming, crash forming, drawing, and bulging as long as the bend formation line can be provided in the blank. However, by considering positional accuracy of the bend formation line and production efficiency, a die set for pressing having a die shape corresponding to the bend formation line is preferred.

Furthermore, the bend radius of the sectional shape of the bend formation line is from 0.5 to 30 mm. Since the bending properties of high-strength steel sheet are poorer than that of mild steel, a bent part may crack when the bend radius of the bend formation line is less than 0.5 mm. In contrast, when the bend radius exceeds 30 mm, the bend formation line is unlikely to become the start point of the processing into the three-dimensional shape in the step of forming the three-dimensional shape. In order to increase efficiency in the step of forming the three-dimensional shape and increase efficiency in prevention of cracking in the bent part, the bend radius is preferably from 1 to 10 mm.

The second-step die set has a structure in which a first-step formed product (formed product having undergone the step of providing the bend formation line) is moved so as to increase or reduce the distance between both the ends of the curved edge portion. This structure has a mechanism that applies forces or a force to both or one of the ends by using a jig, thereby moving the ends or the end inward or outward.

In the step of forming the three-dimensional shape, both the end portions of the curved edge portion themselves are also processed into three-dimensional shapes as the both the end portions are moved. Thus, there is a problem in that a mechanism that can still apply a force or forces even when both the end portions are processed into the three-dimensional shapes is required. Furthermore, both the end portions of the curved edge portion are rotated about a position that becomes the start point of the processing into the three-dimensional shapes. Thus, application of the force or the forces is required even when both the end portions are rotated. However, there also is a problem in that realizing such a movement of a die set makes the mechanism complex.

As a solution to the above-described problems, the part or parts where the force or the forces are applied preferably have a curved surface shape or curved surface shapes. By using a mechanism that causes the curved surface shape or the curved surface shapes provided on the die set to press against the end portion or the end portions of the curved edge portion, the position or positions of a contact point or contact points where the first-step formed product and the die set is brought into contact with each other are sequentially changed on the curved surface or the curved surfaces as the end portions are processed into the three-dimensional shape and rotated. This allows the above-described problems to be solved only by a simple movement of the die set, for example, a linear motion. Specifically, it is sufficient that a mechanism, in which a circular hole is provided in the blank or the first-step formed product and this circular hole is pressed by a columnar pin, be provided. As alternative means, an end portion of the blank or the first-step formed product is formed to have an arc shape.

In order to increase the stability of forming, it is preferable that a mechanism move one or both the end portions while holding both the end portions so that the first-step formed product is not moved out of the die set. When holding, it is preferable that the first-step formed product be held simply by an upper and lower dies or the like so that the first-step formed product is movable while being maintained in the horizontal position. However, when the first-step formed product is moved while simply maintained in the horizontal position, rising of part of the first-step formed product being held during forming is blocked, and consequently, there exists part of the first-step formed product where a desired shape of the metal component with a three-dimensional edge cannot be provided. Thus, it is preferable that the first-step die set has a structure which provides a flat catch portion and a middle portion in the blank. The middle portion is connected from the catch portion to both ends or an intermediate region of a portion of a main body of the blank where a bend formation line is provided or at least one of a plurality of bend formation lines are provided. By causing the middle portion to be in contact with the part where an angle relative to the horizontal direction continuously changes during formation, both the end portions can be easily moved while maintaining the catch portion in the horizontal position.

Furthermore, it is preferable that a technique by which curved surfaces are formed at contact points of the catch portions where the catch portions are brought into contact with the second-step die set be applied. Furthermore, by setting the diameters of the circular holes provided in the first-step formed product and the diameters of the columnar pins of the second-step die set to be the same, the ends of the curved edge portion and the pins are rotated in the same plane while constantly being kept separated from one another by a fixed distance. Thus, the catch portions can be easily held. This is similarly applicable also to an embodiment in which the end portion of the blank or the first-step formed product has the arc shape.

The mechanism of the die set that moves both the end portions of the curved edge portion of the first-step formed product may be, as a method of utilizing the vertical movement by converting the direction of the vertical movement, a mechanism utilizing an inclined surface such as a cam mechanism, a link mechanism, or a mechanism utilizing a lever other than the mechanism that directly transmits the vertical movement of sliding of the pressing machine through a jig such as a punch. Furthermore, a cylinder utilizing electrical power, air pressure, or oil pressure may be used other than the drive force of the pressing machine.

In the step of forming the three-dimensional shape, when deformation of a portion is more easily performed than processing of the first-step formed product into the three-dimensional shape from the bend formation line as the start point, this part is preferentially deformed. In order to prevent defective formation such as buckling of the bend formation line, it is effective that the curved edge portion of the first-step formed product in which cracking and wrinkling may occur is preferentially processed into the three-dimensional shape. For this purpose, it is preferable that, in a region around the curved edge portion that is desired to be preferentially processed into the three-dimensional shape, a plurality of the bend formation lines be provided, the plurality of bend formation lines are curved lines, and a portion of at least one of the plurality of curved lines have a larger curvature than those of curved portions continuous with the portion of the at least one of the plurality of curved lines on both sides. The increase in the curvature of the bend formation line increases the difference between the line lengths on both the sides of the bend formation line which is the border between both the sides relative to movement amounts of both the end portions of the curved edge portion. Thus, the curved edge portion is easily processed into the three-dimensional shape.

When processing of the curved edge portion into the three-dimensional shape is locally performed, the other part of the curved edge portion may be insufficiently processed into the three-dimensional shape. As a countermeasure against this problem, it is effective to design a second-step die set so as to press a vertical wall portion adjacent to the part of the curved edge portion locally processed into the three-dimensional shape while the curved edge portion is being processed into the three-dimensional shape. By pressing the curved edge portion being processed into the three-dimensional shape, it is unavoidable that part around the pressed part is processed into the three-dimensional shape. Thus, by using the second-step die set with pressing jigs arranged in various required parts, a large region can be processed into a three-dimensional shape.

Furthermore, by correcting the shape of the curved edge portion while the curved edge portion is being processed into the three-dimensional shape or after the curved edge portion has been processed into the three-dimensional shape by the second-step die set, the curved edge portion can be processed into a desired shape by forming. A correction method may be any one of methods including crash forming, coining, ironing, reshaping by restriking, and so forth as long as the shape can be corrected by the method. More preferably, the curved edge portion is reshaped by restriking with a cam mechanism. In order to perform processing such as crash forming, coining, ironing, or restriking, a jig including a pair of male and female dies used to process a formed product or a jig that used to secure the formed product is necessary. However, the shape around the curved edge portion is likely to be irregularly varied when the curved edge portion is processed into the three-dimensional shape. Thus, there may be a case where the shape of the jig does not match the shape of a finished product until processing of the curved edge portion into the three-dimensional shape is completed and a case where installation of the jig is difficult because of interference of the jig with the formed product. Thus, by moving the jig with a cam mechanism, the jig can be moved to a position where the jig does not interfere with the formed product at time other than time when the shape of the curved edge portion is corrected. Furthermore, by using a restriking jig, the curved edge portion locally processed into the three-dimensional shape or wrinkling can be corrected.

In the case where the bend formation line and the curved edge portion or the bend formation lines of the first-step formed product are not equally spaced from one another, as the curved edge portion is processed into the three-dimensional shape with the second-step die set, the bend formation line or the bend formation lines attempt to be processed into an arcuate three-dimensional shape or arcuate three-dimensional shapes with the start point or the start points at the top or the tops when the bend formation line or the bend formation lines are seen from a horizontal surface. At this time, when the bend formation line or the bend formation lines are pressed, deformation in the first-step formed product is distributed to other positions. Thus, the bend formation line or the bend formation lines can be prevented from being processed into the arcuate three-dimensional shape or the arcuate three-dimensional shapes. The position or the positions to be pressed are preferably around the top or the tops of the arcuate shape or the arcuate shapes. A pressing method may be any method such as installation of a metal plate or metal plates near the bend formation line or the bend formation lines. When the processing of the bend formation line or the bend formation lines into the three-dimensional shape or the three-dimensional shapes is excessively performed, the bend formation line or the bend formation lines may buckle near the start point or the start points. Thus, this produces an effect that prevents the bend formation line or the bend formation lines from buckling. Furthermore, since the bend formation line or the bend formation lines can be prevented from bucking, portions of the first-step formed product on both the end sides of the curved edge portion can be further smoothly moved. This also allows the curved edge portion to be further effectively processed into the three-dimensional shape.

The die sets for manufacturing may include the first-step die set and the second-step die set. The first-step die set is used for the step of providing the bend formation line, in which the downward or upward bend formation line is provided along the curve of the curved edge portion in the curved edge portion. The second-step die set is used for the step of forming the three-dimensional shape, which is performed next to the step of providing the bend formation line and in which the curved edge portion, or further, the curved edge portion and the part of the blank adjacent to the curved edge portion are processed into the three-dimensional shape from the bend formation line as the start point by pressing a central portion between both the ends of the curved edge portion so that a movement is performed so as to reduce the distance between both the ends. Here, types of the curved line having both the ends include a bend formation line having both ends.

When the bend formation line is provided in the step of providing the bend formation line, the central portion of both the ends of the curved edge portion is pressed so that a movement is perform so as to reduce the distance between both the ends in the step of forming the three-dimensional shape, which is performed next to the step of providing the bend formation line. This causes one of both sides of the bend formation line separated by the bend formation line as the border between both the sides to naturally ascend or descend relative to the other because of the difference between the line lengths on both the sides of the bend formation line. This allows and facilitates the processing of the curved edge portion, or further, the curved edge portion and the part of the blank adjacent to the curved edge portion into the three-dimensional shape from the bend formation line as the start point. Without the step of providing the bend formation line, the processing into the three-dimensional shape by the step of forming the three-dimensional shape is very difficult to be performed.

The second-step die set has a structure in which the central portion between the both the ends of the curved edge portion of the first-step formed product (formed product having undergone the step of providing the bend formation line) is pressed so that the movement is performed so as to reduce the distance between both the ends of the curved edge portion. This structure has a mechanism that causes the curved edge portion to rise while rotating both the ends by applying a force to the central portion with a jig. When it is attempted to cause the curved edge portion to rise by the related-art press forming, the length of the raw material is insufficient at part of the raw material to be brought into contact with the jig. This causes cracks in the stretched flange. In contrast, according to disclosed embodiments, both the end portions of the curved edge portion are rotated about the position that becomes the start point of the processing into the three-dimensional shape. This can compensate for lack of length of the raw material. Here, in order to hold the first-step formed product, it is preferable to press a region near the bend formation line, which becomes the start point when processing into the three-dimensional shape.

FIGS. 1(*a*)-1(*d*) include schematic views illustrating a first embodiment. As illustrated in views (a), (b), and (c) of FIG. 1, the structure of a first-step die set for manufacturing a member having a V-shaped section by providing a downward bend formation line (bend formation line for downward bend) 110 in a blank 10. The first-step die set includes a die 1 and a punch 2, which have sectional shapes corresponding to the V-shaped section of the product. Reference numerals 15 and 16 respectively denote a curved edge portion and ends of the curved edge portion. Furthermore, SOA and COA are respectively denote observation parts where whether or not wrinkling occurs and where whether or not cracking occurs is observed in the product manufactured from the blank 10 (similarly denoting hereafter).

View (d) of FIG. 1 illustrates the shape of a second-step formed product (a metal component with a three-dimensional edge) obtained by further forming a first-step formed product having been obtained with the first-step die set illustrated in views (a), (b), and (c) of FIG. 1 with the second-step die set, which will be described later.

Figure 2:
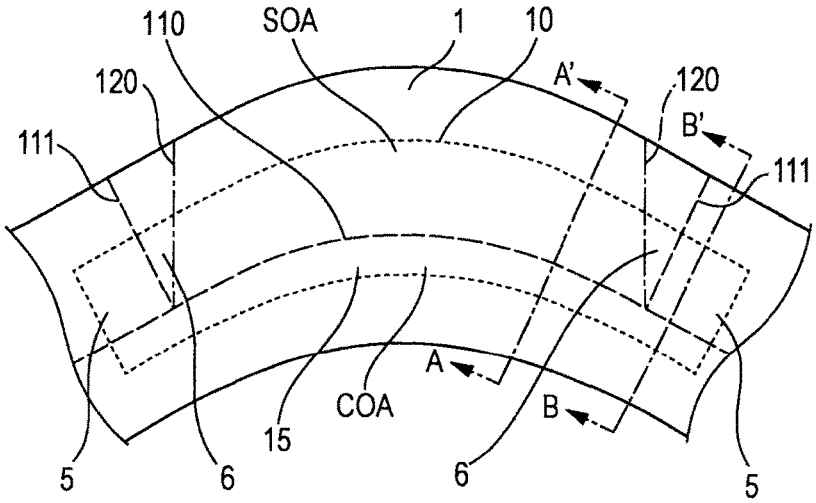
FIG. 2(*a*) includes a schematic view according to a second embodiment.
Figure 2:
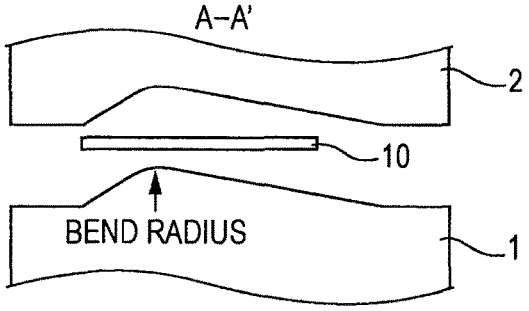
Figure 2:
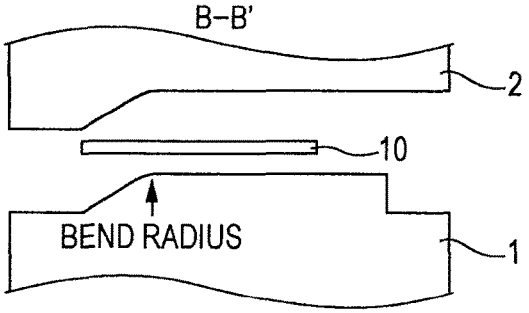
Figure 2:
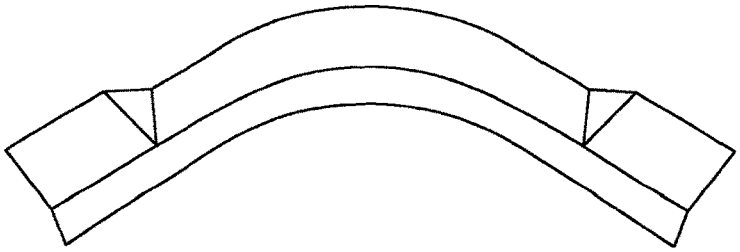

FIGS. 2(*a*)-2(*d*) include schematic views illustrating a second embodiment. As illustrated in views (a), (b), and (c) of FIG. 2, the structure of the first-step die set with which downward bend formation lines 111 and upward bend formation lines 120 (bend formation lines for upward bend) are added to the blank 10 of the first embodiment, so that middle portions 6 and catch portions 5 (corresponding to the ends 16 of the curved edge portion 15 illustrated in FIG. 1) are provided. Here, elements that are the same as or correspond to those illustrated in the above-described drawing are denoted by the same reference numerals, and description thereof is omitted.

View (d) of FIG. 2 illustrates the shape of the second-step formed product (metal component with a three-dimensional edge) obtained by further forming the first-step formed product having been obtained with the first-step die set illustrated in views (a), (b), and (c) of FIG. 2 with the second-step die set, which will be described later.

Figure 3:
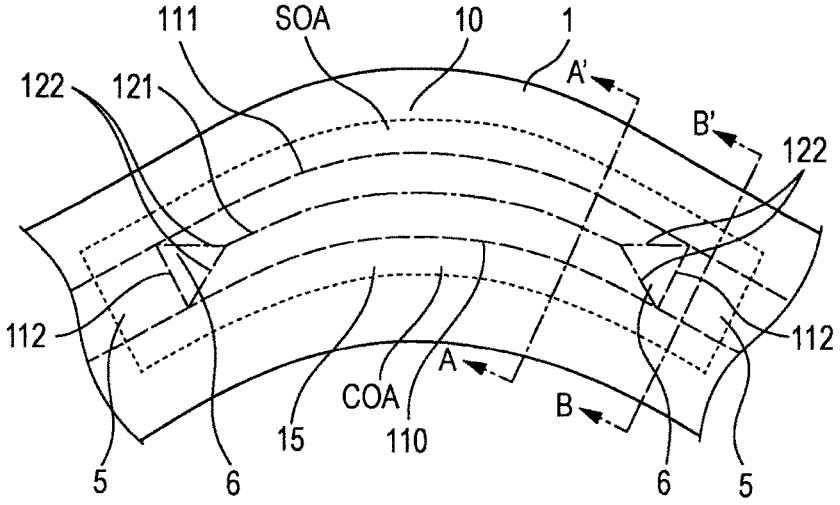
FIG. 3(*a*) includes a schematic view according to a third embodiment.
Figure 3:
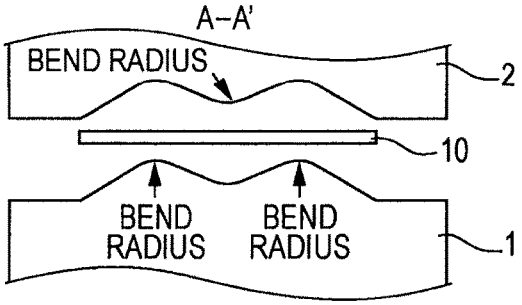
Figure 3:
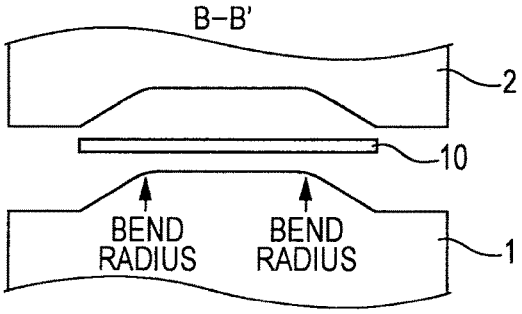
Figure 3:
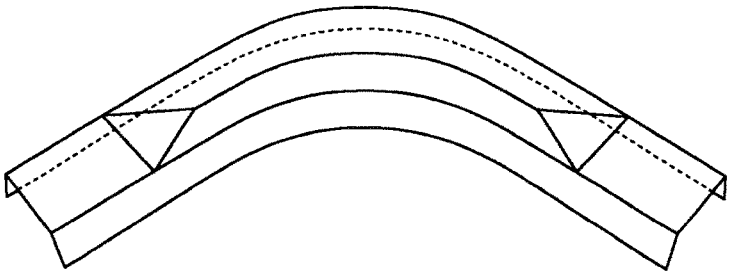

FIGS. 3(*a*)-3(*d*) include schematic views illustrating a third embodiment. As illustrated in views (a), (b), and (c) of FIG. 3, the structure of the first-step die set with which, in order to manufacture a member having an M-shaped section, the downward bend formation lines 111 and 112 and upward bend formation lines 121 and 122 are added in the first embodiment, so that the middle portions 6 and the catch portions 5 are provided. Here, elements that are the same as or correspond to those illustrated in the above-described drawings are denoted by the same reference numerals, and description thereof is omitted.

View (d) of FIG. 3 illustrates the shape of the second-step formed product (metal component with a three-dimensional edge) obtained by further forming the first-step formed product having been obtained with the first-step die set illustrated in views (a), (b), and (c) of FIG. 3 with the second-step die set, which will be described later.

Figure 4:
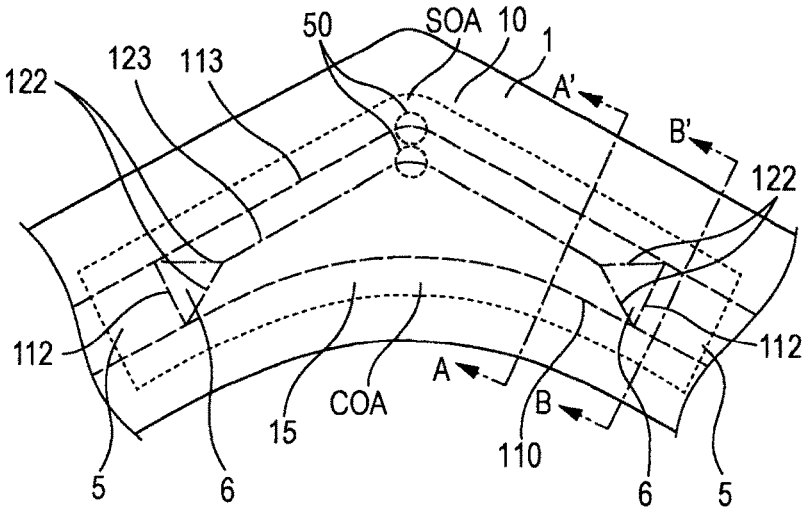
FIG. 4(*a*) includes a schematic view according to a fourth embodiment.
Figure 4:
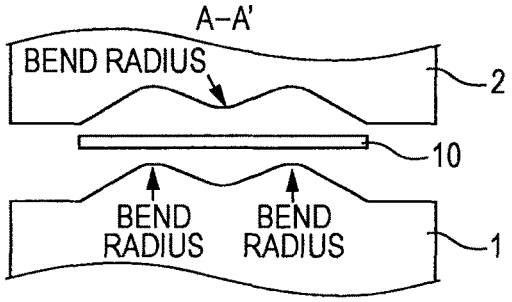
Figure 4:
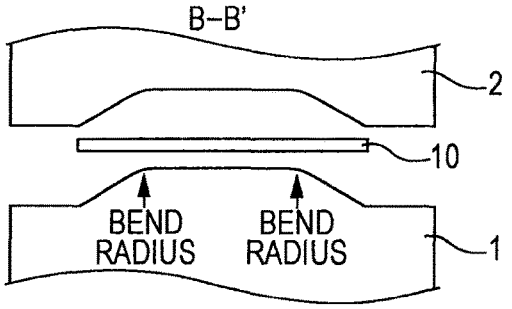
Figure 4:
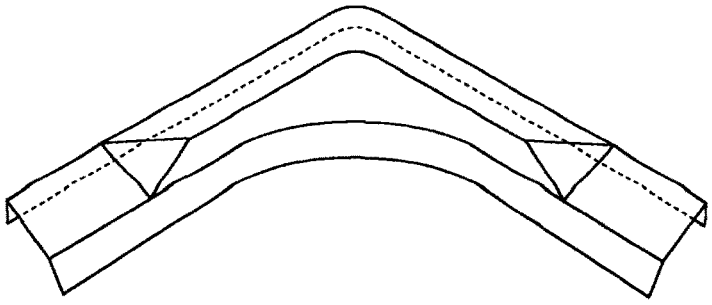

FIGS. 4(*a*)-4(*d*) include schematic views illustrating a forth embodiment. As illustrated in views (a), (b), and (c) of FIG. 4, the structure of the first-step die set. In this case, a downward bend formation line 113 and an upward bend formation line 123 are respectively provided instead of the downward bend formation line 111 and the upward bend formation line 121 of the third embodiment with the first-step die set. The downward bend formation line 113 and the upward bend formation line 123 each have a portion 50 having a lager curvature than those of the other portions. Here, elements that are the same as or correspond to those illustrated in the above-described drawings are denoted by the same reference numerals, and description thereof is omitted.

View (d) of FIG. 4 illustrates the shape of the second-step formed product (metal component with a three-dimensional edge) obtained by further forming the first-step formed product having been obtained with the first-step die set illustrated in views (a), (b), and (c) of FIG. 4 with the second-step die set, which will be described later.

Figure 5:
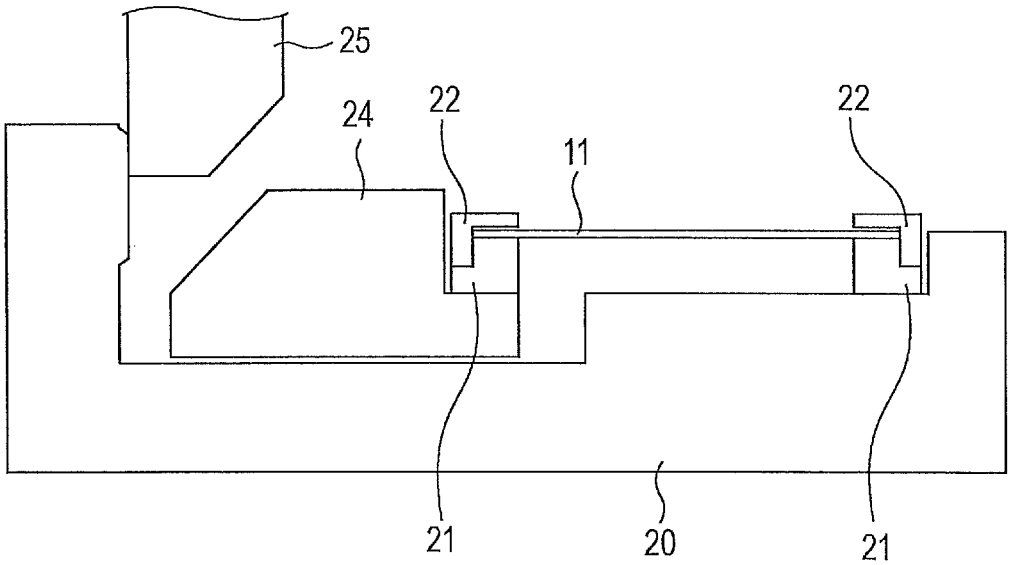
FIG. 5 includes schematic views according to a fifth embodiment.
Figure 5:
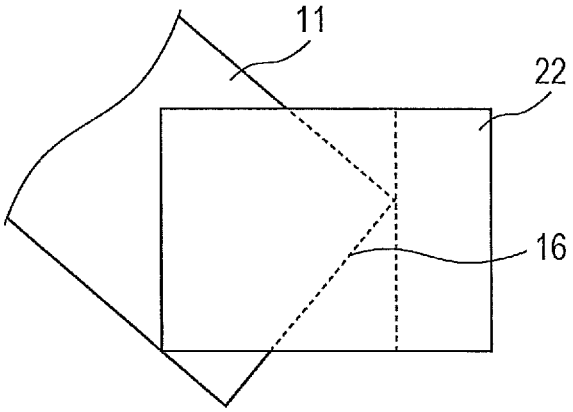
Figure 5:
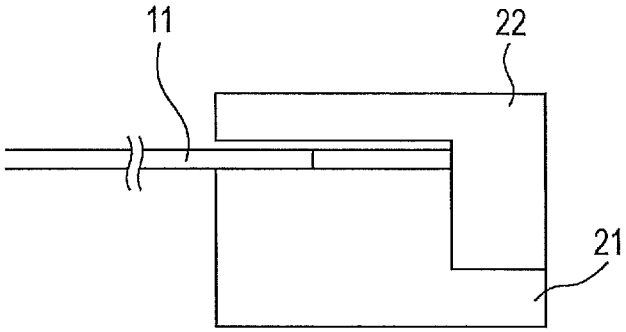

FIG. 5 includes schematic views illustrating a fifth embodiment. FIG. 5 illustrates the structure of the second-step die set. The ends 16 of the curved edge portion 15 of a first-step formed product 11 are held by securing blocks (lower and upper) 21 and 22, and a cam slider 24 and cam driver 25 are provided as a mechanism that presses the securing blocks 21 and 22. The ends 16 of the curved edge portion 15 are pressed by contact surfaces of the securing blocks (upper) 22, and accordingly, the distance between one of the ends 16 of the curved edge portion 15 and the opposite end 16 of the curved edge portion 15 is reduced.

Figure 6:
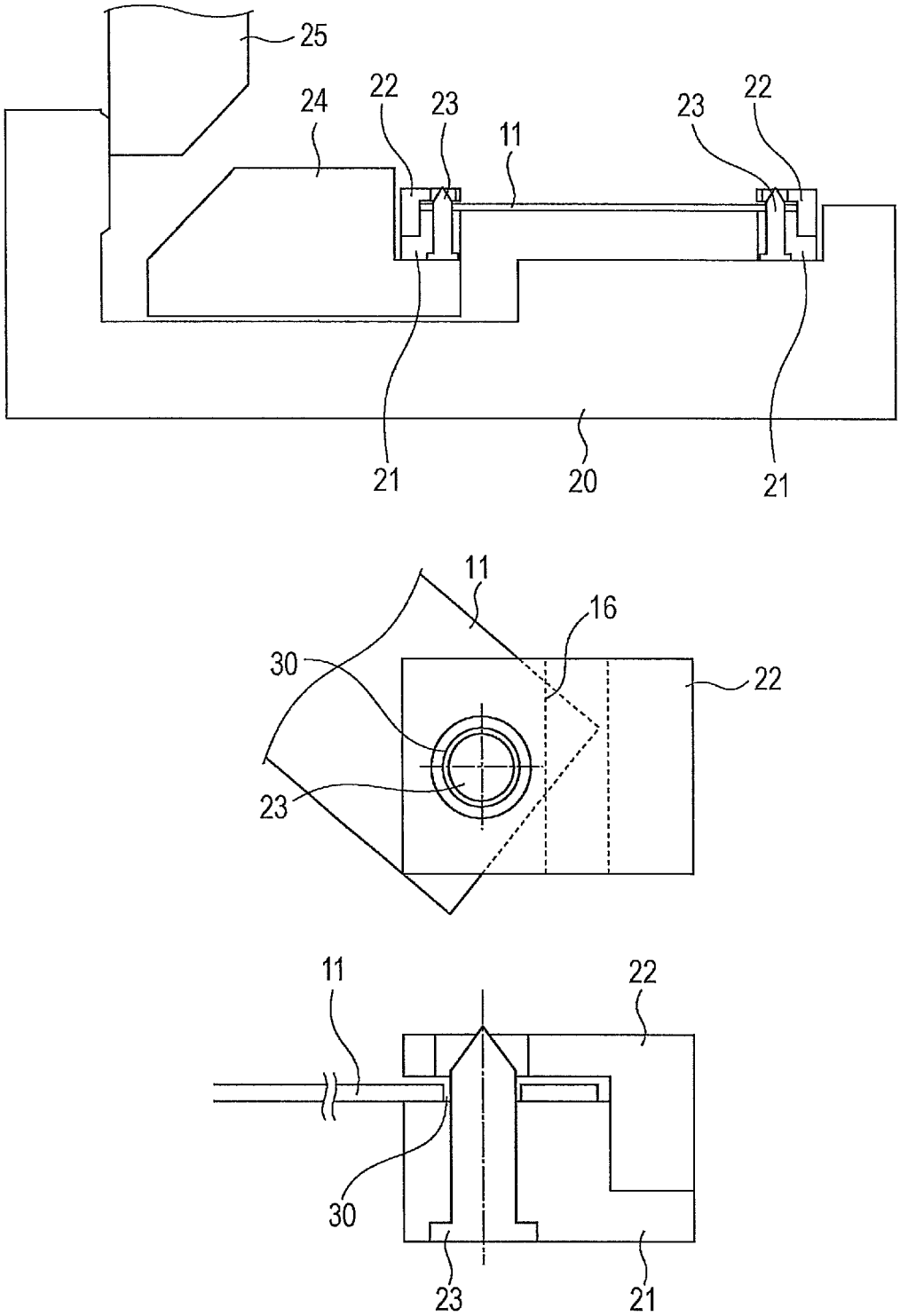
FIG. 6 includes schematic views according to a sixth embodiment.

FIG. 6 includes schematic views illustrating a sixth embodiment. FIG. 6 illustrates the structure of the second-step die set in which, as mechanisms that hold the first-step formed product 11, columnar pilot pins 23 are added to the second-step die set of the fifth embodiment. Circular holes 30 are formed in the first-step formed product 11 at a stage where the blank for the first-step formed product 11 is manufactured. The circular holes 30 allow the pilot pins 23 to be inserted therethrough. Here, elements that are the same as or correspond to those illustrated in the above-described drawings are denoted by the same reference numerals, and description thereof is omitted.

Figure 7:
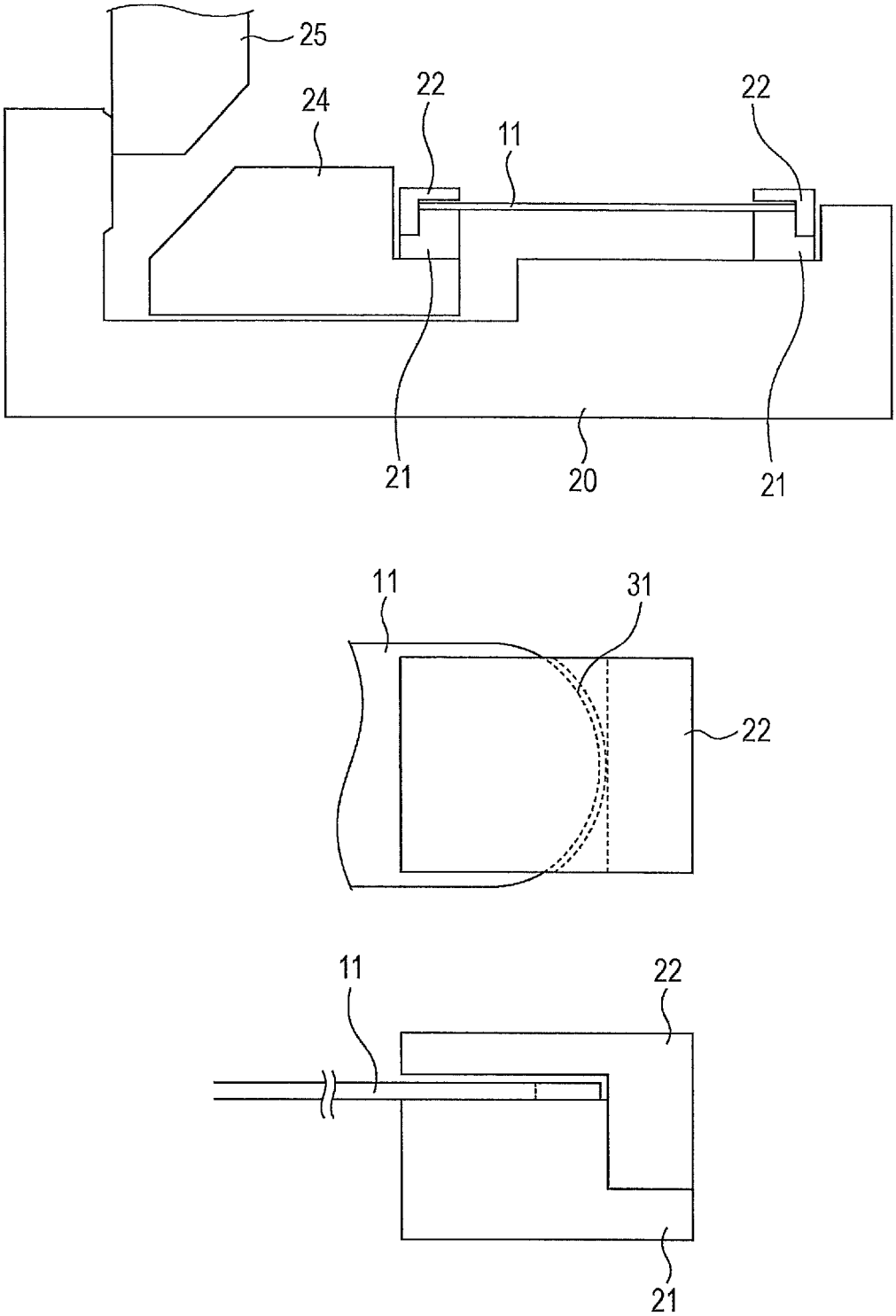
FIG. 7 includes schematic views according to a seventh embodiment.

FIG. 7 includes schematic views illustrating a seventh embodiment. FIG. 7 illustrates the structure of a second-step die set in which, as mechanisms that hold the first-step formed product 11, the ends of the curved edge portion have convex arc shapes and contact surfaces of the securing blocks (upper) 22 have concave arc shapes, so that the ends of the curved edge portion and the contact surfaces of the securing blocks (upper) 22 form arc-shaped contact portions 31 in the fifth embodiment. Here, elements that are the same as or correspond to those illustrated in the above-described drawings are denoted by the same reference numerals, and description thereof is omitted.

Figure 8:
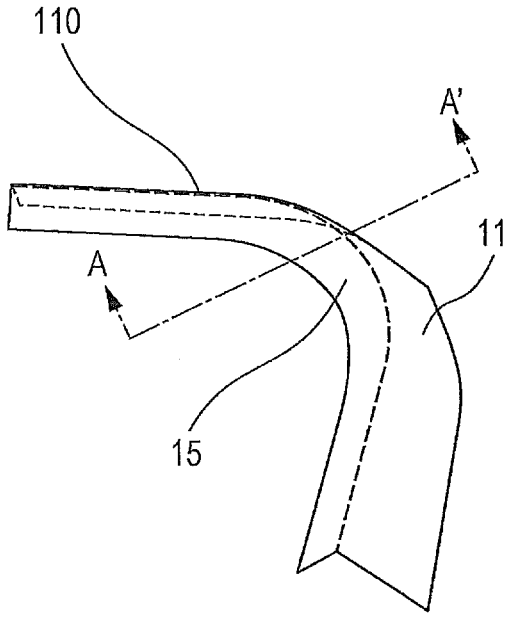
FIG. 8 includes schematic views according to an eighth embodiment.
Figure 8:
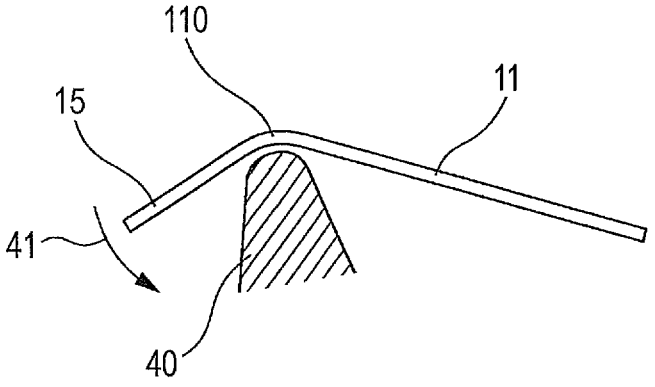

FIG. 8 includes schematic views illustrating an eighth embodiment. FIG. 8 illustrates a case in which the second-step die set includes a pressing jig 40 that presses the curved edge portion. The curved edge portion is locally processed into the three-dimensional shape when the curved edge portion rises 41 (arrow 41). Here, elements that are the same as or correspond to those illustrated in the above-described drawings are denoted by the same reference numerals, and description thereof is omitted.

Here, when seen in section A-A' in FIG. 8, the curved edge portion 15 is processed into the three-dimensional shape while being rotated about the downward bend formation line 110 in the arrow 41 direction. At this time, the curved edge portion 15 collides with the pressing jig 40 when the pressing jig 40 is secured (held) at the position illustrated in the drawing. Thus, even when the processing of the curved edge portion 15 into the three-dimensional is further attempted while the curved edge portion 15 is being rotated, the curved edge portion 15 is pressed by the jig 40.

Figure 9:
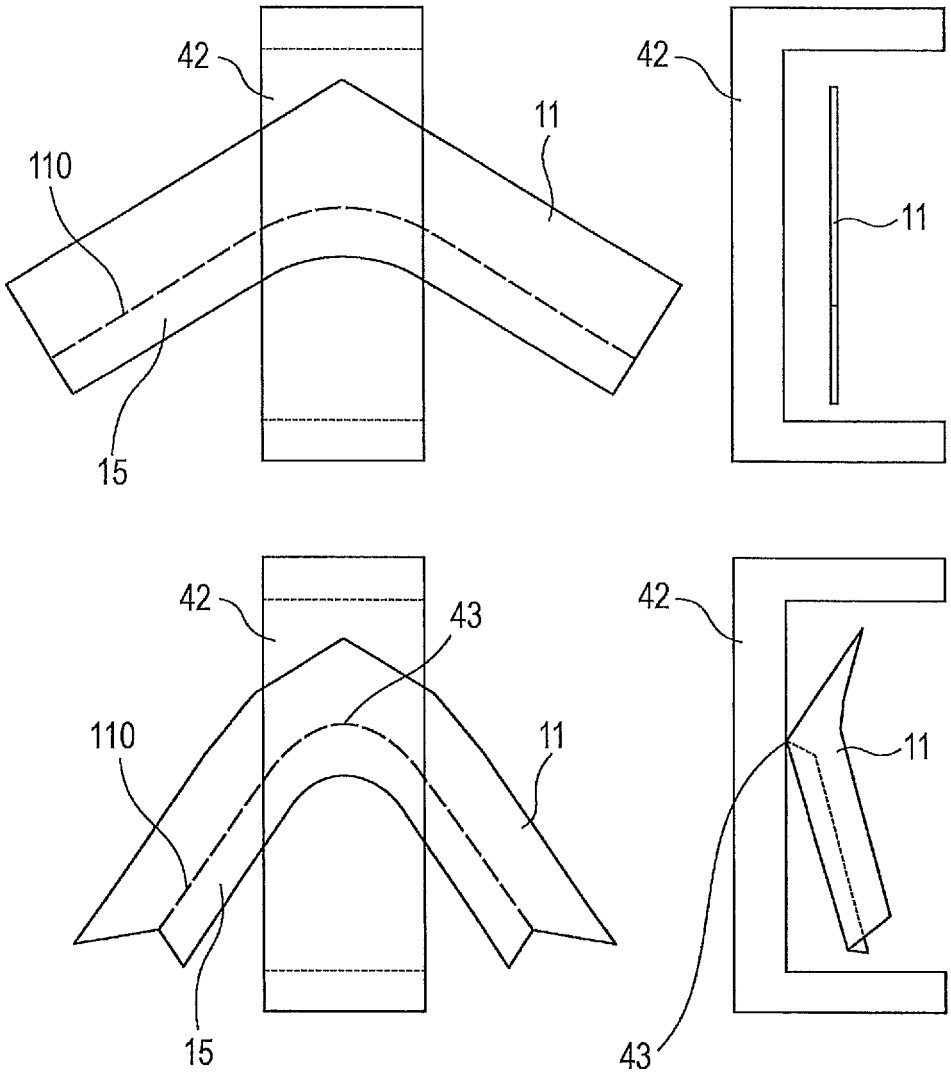
FIG. 9 includes schematic views according to a ninth embodiment.

FIG. 9 includes schematic views illustrating a ninth embodiment. FIG. 9 illustrates a case where the second-step die set includes a pressing block 42 that suppresses excessive rise of a rise 43 at an arc-shaped portion of the downward bend formation line 110 that is processed into the arcuate three-dimensional shape. Here, elements that are the same as or correspond to those illustrated in the above-described drawings are denoted by the same reference numerals, and description thereof is omitted.

Figure 10:
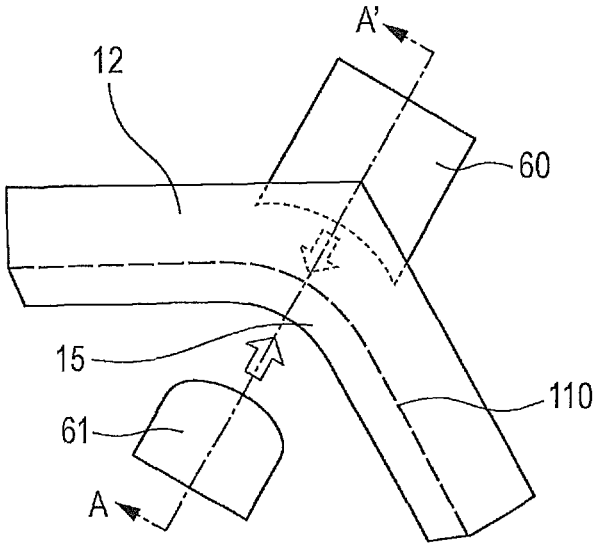
FIG. 10 includes schematic views according to a tenth embodiment.
Figure 10:
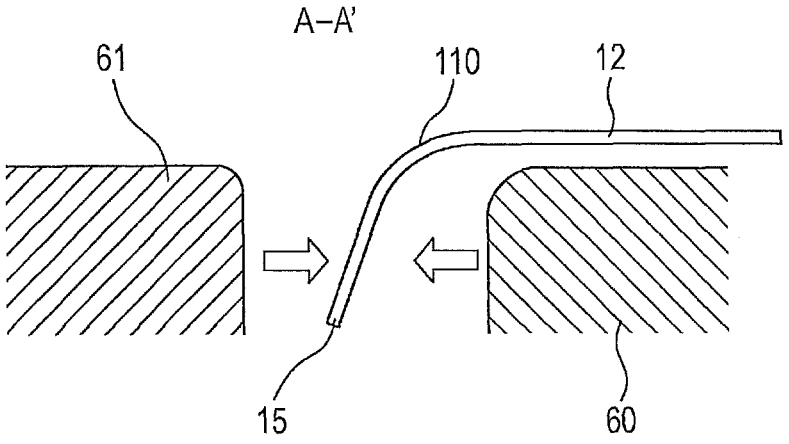

FIG. 10 includes schematic views illustrating a tenth embodiment. FIG. 10 illustrates a case where the second-step die set includes restrike tools (concave and convex) 60 and 61. The restrike tools 60 and 61 correct the curved edge portion 15 that is locally processed into the three-dimensional shape of the formed product during or after the second step 12 so that the bend edge portion 15 has a desired shape. Here, elements that are the same as or correspond to those illustrated in the above-described drawings are denoted by the same reference numerals, and description thereof is omitted.

Figure 11:
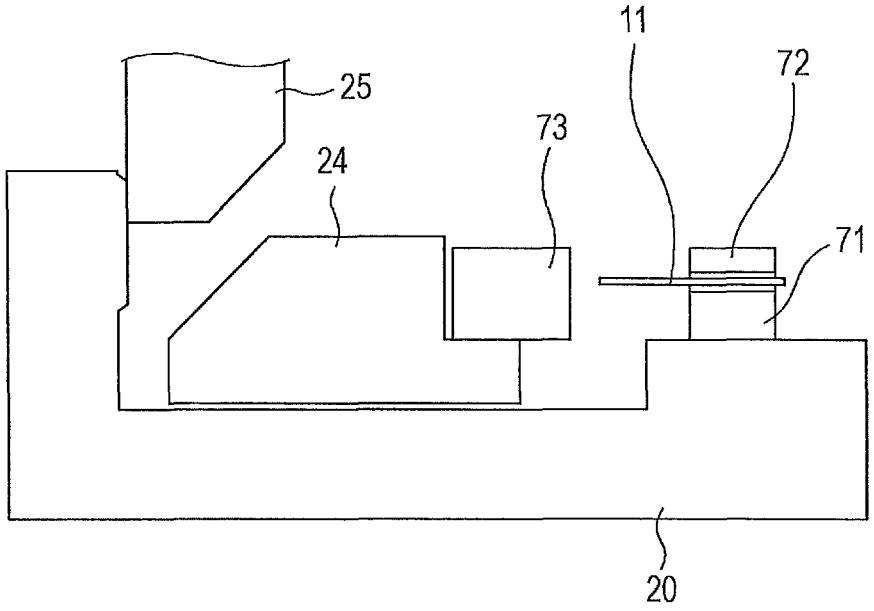
FIG. 11 includes schematic views according to an eleventh embodiment.
Figure 11:
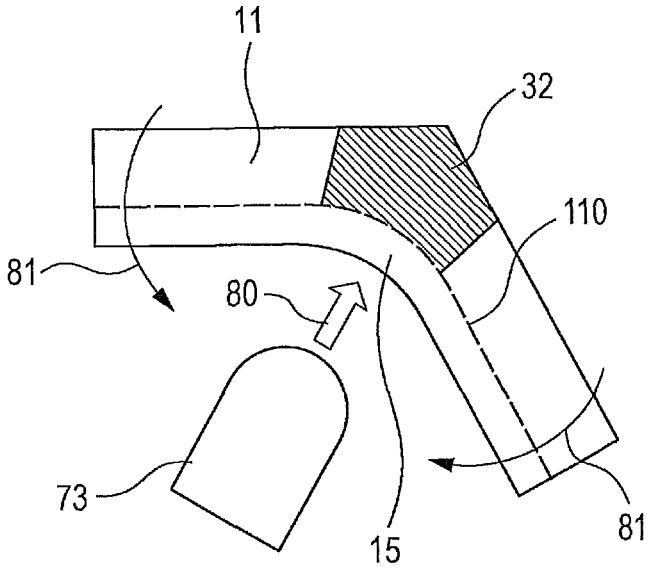

FIG. 11 includes schematic views illustrating an eleventh embodiment. FIG. 11 illustrates the structure of the second-step die set. In this example, a punch 73 that is brought into contact with a central part of the curved edge portion 15 of the first-step formed product 11 is urged by the cam slider 24 and the cam driver 25, thereby applying a push 80 to the central portion so as to rotate 81 both the ends. This reduces the distance between both the ends. Furthermore, in order to restrain a problematic vertical movement of the first-step formed product 11, a non-curved edge portion, which is adjacent to the central portion pressed by the punch 73 with the downward bend formation line 110 interposed therebetween, serves as a holding portion 32. The holding portion is held by plate pressing pads (lower and upper) 71 and 72 so that the holding portion can only slide in the horizontal direction. The punch 73, the cam slider 24, the cam driver 25, and the plate pressing pads 71 and 72 are supported by a holder 20.

EXAMPLES

In order to check the effects of the bend radius of the bent section in the first step, the metal components with a three-dimensional edge were manufactured. The raw material of each of the metal components with a three-dimensional edge was a blank cut from a steel sheet having mechanical characteristics listed in Table 1. Forming methods listed in Table 2 were used to manufacture the metal components with a three-dimensional edge. Whether or not cracking occurred and whether or not wrinkling occurred were determined for the obtained components.

Furthermore, coincidence with a target shape was visually observed. Shape evaluation is determined as follows: the metal components with a three-dimensional edge having shapes not preferably coincident with the target shape are marked with "C"; the metal components with a three-dimensional edge having shapes preferably coincident with the target shape are marked with "B"; and the metal components with a three-dimensional edge having shapes further preferably coincident with the target shape are marked with "A".

As a result, as listed in Table 2, it has been confirmed that preferable results can be obtained when the bend radius of the bent section in the first step is from 0.5 to 30 mm.

Next, the metal components with a three-dimensional edge were manufactured. The raw material of each of the metal components with a three-dimensional edge was a blank cut from a steel sheet having mechanical characteristics listed in Table 1. Forming methods listed in Table 3 (Tables 3-1 to 3-3) were used to manufacture the metal components with a three-dimensional edge. Whether or not wrinkling occurred and whether or not cracking occurred were determined for the obtained components.

Furthermore, coincidence with a target shape was visually observed. Shape evaluation is determined as follows: the metal components with a three-dimensional edge having shapes equally coincident with the target shape when compared to those of the fifth embodiment are marked with "B"; and the metal components with a three-dimensional edge having shapes more preferably coincident with the target shape than those of the fifth embodiment are marked with "A".

Here, the bend angles of the downward bend formation lines and the upward bend formation lines of the examples are set to 90 degrees. Furthermore, the bend radius of the bent section in the first step is set to from 0.5 to 30 mm. Manufactured components of comparative examples No. 1 to 4 are respectively the same as those of the first to fourth embodiments. Whether or not cracking occurs is determined by visually observing the observation part COA illustrated in FIGS. 1 to 4 and whether or not wrinkling occurs is determined by visually observing the observation part SOA illustrated in FIGS. 1 to 4. The results are listed in Table 2.

According to Table 2, when a metal component with a three-dimensional edge is manufactured by processing a curved edge portion of the blank formed of a high-strength steel sheet into a three-dimensional shape by forming, cracking and wrinkling occur in the related-art press forming. In contrast, a desired component can be manufactured without the occurrences of cracking and wrinkling according to embodiments.

Furthermore, together with the eighth and ninth embodiments, the metal components with a three-dimensional edge having the shape that is further preferably coincident with the target shape (shape evaluation is "A") can be manufactured.

TABLE 1

| Sheet thickness (mm) | YS (MPa) | TS (MPa) | EI (%) |
|---|---|---|---|
| 2.3 | 810 | 1190 | 13 |

TABLE 2

| | Forming method | | | | | |
|---|---|---|---|---|---|---|
| | First step | | | | | |
| No. | Method | Bend radius | Second step | | Success/failure in forming | Remarks |
| a | First embodiment | 0.4 | Not performed | C | Cracking in first step | Comparative example |
| b | First embodiment | 0.5 | Fifth embodiment | B | No wrinkling/No cracking | Example |
| c | First embodiment | 1 | Fifth embodiment | A | No wrinkling/No cracking | Example |
| d | First embodiment | 10 | Fifth embodiment | A | No wrinkling/No cracking | Example |
| e | First embodiment | 30 | Fifth embodiment | B | No wrinkling/No cracking | Example |
| f | First embodiment | 35 | Fifth embodiment | C | Wrinkling in second step | Comparative example |

TABLE 3-1

| | Forming method | | | | | Shape | |
|---|---|---|---|---|---|---|---|
| No. | First step | Second step | Assisting jig | | Success/failure in forming | evaluation | Remarks |
| 1 | Related-art press forming (shape: first embodiment) | | | C | Cracking and wrinkling occurred | C | Comparative example |
| 2 | Related-art press forming (shape: second embodiment) | | | C | Cracking and wrinkling occurred | C | Comparative example |
| 3 | Related-art press forming (shape: third embodiment) | | | C | Cracking and wrinkling occurred | C | Comparative example |
| 4 | Related-art press forming (shape: fourth embodiment) | | | C | Cracking and wrinkling occurred | C | Comparative example |
| 5 | First embodiment | Fifth embodiment | Non | B | No cracking/No wrinkling | B | Example |
| 6 | First embodiment | Fifth embodiment | Eighth embodiment | B | No cracking/No wrinkling | A | Example |
| 7 | First embodiment | Fifth embodiment | Ninth embodiment | B | No cracking/No wrinkling | A | Example |
| 8 | First embodiment | Fifth embodiment | Tenth embodiment | B | No cracking/No wrinkling | A | Example |
| 9 | First embodiment | Fifth embodiment | Eighth and ninth embodiments | B | No cracking/No wrinkling | A | Example |
| 10 | First embodiment | Fifth embodiment | Eighth and tenth embodiments | B | No cracking/No wrinkling | A | Example |
| 11 | First embodiment | Fifth embodiment | Ninth and tenth embodiments | B | No cracking/No wrinkling | A | Example |
| 12 | First embodiment | Fifth embodiment | Eighth, ninth, and tenth embodiments | B | No cracking/No wrinkling | A | Example |
| 13 | First embodiment | Sixth embodiment | Non | B | No cracking/No wrinkling | B | Example |
| 14 | First embodiment | Sixth embodiment | Eighth embodiment | B | No cracking/No wrinkling | A | Example |
| 15 | First embodiment | Sixth embodiment | Ninth embodiment | B | No cracking/No wrinkling | A | Example |

TABLE 3-1-continued

| No. | Forming method | | | | Success/failure in forming | Shape evaluation | Remarks |
|---|---|---|---|---|---|---|---|
| | First step | Second step | Assisting jig | | | | |
| 16 | First embodiment | Sixth embodiment | Tenth embodiment | B | No cracking/No wrinkling | A | Example |
| 17 | First embodiment | Sixth embodiment | Eighth and ninth embodiments | B | No cracking/No wrinkling | A | Example |
| 18 | First embodiment | Sixth embodiment | Eighth and tenth embodiments | B | No cracking/No wrinkling | A | Example |
| 19 | First embodiment | Sixth embodiment | Ninth and tenth embodiments | B | No cracking/No wrinkling | A | Example |
| 20 | First embodiment | Sixth embodiment | Eighth, ninth, and tenth embodiments | B | No cracking/No wrinkling | A | Example |
| 21 | First embodiment | Seventh embodiment | Non | B | No cracking/No wrinkling | B | Example |
| 22 | First embodiment | Seventh embodiment | Eighth embodiment | B | No cracking/No wrinkling | A | Example |
| 23 | First embodiment | Seventh embodiment | Ninth embodiment | B | No cracking/No wrinkling | A | Example |
| 24 | First embodiment | Seventh embodiment | Tenth embodiment | B | No cracking/No wrinkling | A | Example |
| 25 | First embodiment | Seventh embodiment | Eighth and ninth embodiments | B | No cracking/No wrinkling | A | Example |
| 26 | First embodiment | Seventh embodiment | Eighth and tenth embodiments | B | No cracking/No wrinkling | A | Example |
| 27 | First embodiment | Seventh embodiment | Ninth and tenth embodiments | B | No cracking/No wrinkling | A | Example |
| 28 | First embodiment | Seventh embodiment | Eighth, ninth, and tenth embodiments | B | No cracking/No wrinkling | A | Example |
| 29 | Second embodiment | Fifth embodiment | Non | B | No cracking/No wrinkling | B | Example |
| 30 | Second embodiment | Fifth embodiment | Eighth embodiment | B | No cracking/No wrinkling | A | Example |
| 31 | Second embodiment | Fifth embodiment | Ninth embodiment | B | No cracking/No wrinkling | A | Example |
| 33 | Second embodiment | Fifth embodiment | Tenth embodiment | B | No cracking/No wrinkling | A | Example |
| 34 | Second embodiment | Fifth embodiment | Eighth and ninth embodiments | B | No cracking/No wrinkling | A | Example |
| 35 | Second embodiment | Fifth embodiment | Eighth and tenth embodiments | B | No cracking/No wrinkling | A | Example |
| 36 | Second embodiment | Fifth embodiment | Ninth and tenth embodiments | B | No cracking/No wrinkling | A | Example |
| 37 | Second embodiment | Fifth embodiment | Eighth, ninth, and tenth embodiments | B | No cracking/No wrinkling | A | Example |
| 32 | Second embodiment | Sixth embodiment | Non | B | No cracking/No wrinkling | B | Example |
| 38 | Second embodiment | Sixth embodiment | Eighth embodiment | B | No cracking/No wrinkling | A | Example |
| 39 | Second embodiment | Sixth embodiment | Ninth embodiment | B | No cracking/No wrinkling | A | Example |
| 40 | Second embodiment | Sixth embodiment | Tenth embodiment | B | No cracking/No wrinkling | A | Example |
| 41 | Second embodiment | Sixth embodiment | Eighth and ninth embodiments | B | No cracking/No wrinkling | A | Example |
| 42 | Second embodiment | Sixth embodiment | Eighth and tenth embodiments | B | No cracking/No wrinkling | A | Example |
| 43 | Second embodiment | Sixth embodiment | Ninth and tenth embodiments | B | No cracking/No wrinkling | A | Example |
| 44 | Second embodiment | Seventh embodiment | Eighth, ninth, and tenth embodiments | B | No cracking/No wrinkling | A | Example |
| 45 | Second embodiment | Seventh embodiment | Non | B | No cracking/No wrinkling | B | Example |
| 46 | Second embodiment | Seventh embodiment | Eighth embodiment | B | No cracking/No wrinkling | A | Example |
| 47 | Second embodiment | Seventh embodiment | Ninth embodiment | B | No cracking/No wrinkling | A | Example |
| 48 | Second embodiment | Seventh embodiment | Tenth embodiment | B | No cracking/No wrinkling | A | Example |
| 49 | Second embodiment | Seventh embodiment | Eighth and ninth embodiments | B | No cracking/No wrinkling | A | Example |
| 50 | Second embodiment | Seventh embodiment | Eighth and tenth embodiments | B | No cracking/No wrinkling | A | Example |

TABLE 3-2

| No. | Forming method | | | | Success/failure in forming | Shape Evaluation | Remarks |
|---|---|---|---|---|---|---|---|
| | First step | Second step | Assisting jig | | | | |
| 51 | Second embodiment | Seventh embodiment | Ninth and tenth embodiments | B | No cracking/No wrinkling | A | Example |
| 52 | Second embodiment | Seventh embodiment | Eighth, Ninth, and tenth embodiments | B | No cracking/No wrinkling | A | Example |
| 53 | Third embodiment | Fifth embodiment | Non | B | No cracking/No wrinkling | B | Example |
| 54 | Third embodiment | Fifth embodiment | Eighth embodiment | B | No cracking/No wrinkling | A | Example |
| 55 | Third embodiment | Fifth embodiment | Ninth embodiment | B | No cracking/No wrinkling | A | Example |
| 56 | Third embodiment | Fifth embodiment | Tenth embodiment | B | No cracking/No wrinkling | A | Example |
| 57 | Third embodiment | Fifth embodiment | Eighth and ninth embodiments | B | No cracking/No wrinkling | A | Example |
| 58 | Third embodiment | Fifth embodiment | Eighth and tenth embodiments | B | No cracking/No wrinkling | A | Example |
| 59 | Third embodiment | Fifth embodiment | Ninth and tenth embodiments | B | No cracking/No wrinkling | A | Example |
| 60 | Third embodiment | Fifth embodiment | Eighth, Ninth, and tenth embodiments | B | No cracking/No wrinkling | A | Example |
| 61 | Third embodiment | Sixth embodiment | Non | B | No cracking/No wrinkling | B | Example |
| 62 | Third embodiment | Sixth embodiment | Eighth embodiment | B | No cracking/No wrinkling | A | Example |
| 63 | Third embodiment | Sixth embodiment | Ninth embodiment | B | No cracking/No wrinkling | A | Example |
| 64 | Third embodiment | Sixth embodiment | Tenth embodiment | B | No cracking/No wrinkling | A | Example |
| 65 | Third embodiment | Sixth embodiment | Eighth and ninth embodiments | B | No cracking/No wrinkling | A | Example |
| 66 | Third embodiment | Sixth embodiment | Eighth and tenth embodiments | B | No cracking/No wrinkling | A | Example |
| 67 | Third embodiment | Sixth embodiment | Ninth and tenth embodiments | B | No cracking/No wrinkling | A | Example |
| 68 | Third embodiment | Sixth embodiment | Eighth, Ninth, and tenth embodiments | B | No cracking/No wrinkling | A | Example |
| 69 | Third embodiment | Seventh embodiment | Non | B | No cracking/No wrinkling | B | Example |
| 70 | Third embodiment | Seventh embodiment | Eighth embodiment | B | No cracking/No wrinkling | A | Example |
| 71 | Third embodiment | Seventh embodiment | Ninth embodiment | B | No cracking/No wrinkling | A | Example |
| 72 | Third embodiment | Seventh embodiment | Tenth embodiment | B | No cracking/No wrinkling | A | Example |
| 73 | Third embodiment | Seventh embodiment | Eighth and ninth embodiments | B | No cracking/No wrinkling | A | Example |
| 74 | Third embodiment | Seventh embodiment | Eighth and tenth embodiments | B | No cracking/No wrinkling | A | Example |

TABLE 3-2-continued

| No. | Forming method: First step | Second step | Assisting jig | | Success/failure in forming | Shape: Evaluation | Remarks |
|---|---|---|---|---|---|---|---|
| 75 | Third embodiment | Seventh embodiment | Ninth and tenth embodiments | B | No cracking/No wrinkling | A | Example |
| 76 | Third embodiment | Seventh embodiment | Eighth, Ninth, and tenth embodiments | B | No cracking/No wrinkling | A | Example |
| 77 | Fourth embodiment | Fifth embodiment | Non | B | No cracking/No wrinkling | B | Example |
| 78 | Fourth embodiment | Fifth embodiment | Eighth embodiment | B | No cracking/No wrinkling | A | Example |
| 79 | Fourth embodiment | Fifth embodiment | Ninth embodiment | B | No cracking/No wrinkling | A | Example |
| 80 | Fourth embodiment | Fifth embodiment | Tenth embodiment | B | No cracking/No wrinkling | A | Example |
| 81 | Fourth embodiment | Fifth embodiment | Eighth and ninth embodiments | B | No cracking/No wrinkling | A | Example |
| 82 | Fourth embodiment | Fifth embodiment | Eighth and tenth embodiments | B | No cracking/No wrinkling | A | Example |
| 83 | Fourth embodiment | Fifth embodiment | Ninth and tenth embodiments | B | No cracking/No wrinkling | A | Example |
| 84 | Fourth embodiment | Fifth embodiment | Eighth, Ninth, and tenth embodiments | B | No cracking/No wrinkling | A | Example |
| 85 | Fourth embodiment | Sixth embodiment | Non | B | No cracking/No wrinkling | B | Example |
| 86 | Fourth embodiment | Sixth embodiment | Eighth embodiment | B | No cracking/No wrinkling | A | Example |
| 87 | Fourth embodiment | Sixth embodiment | Ninth embodiment | B | No cracking/No wrinkling | A | Example |
| 88 | Fourth embodiment | Sixth embodiment | Tenth embodiment | B | No cracking/No wrinkling | A | Example |
| 89 | Fourth embodiment | Sixth embodiment | Eighth and ninth embodiments | B | No cracking/No wrinkling | A | Example |
| 90 | Fourth embodiment | Sixth embodiment | Eighth and tenth embodiments | B | No cracking/No wrinkling | A | Example |
| 91 | Fourth embodiment | Sixth embodiment | Ninth and tenth embodiments | B | No cracking/No wrinkling | A | Example |
| 92 | Fourth embodiment | Sixth embodiment | Eighth, Ninth, and tenth embodiments | B | No cracking/No wrinkling | A | Example |
| 93 | Fourth embodiment | Seventh embodiment | Non | B | No cracking/No wrinkling | B | Example |
| 94 | Fourth embodiment | Seventh embodiment | Eighth embodiment | B | No cracking/No wrinkling | A | Example |
| 95 | Fourth embodiment | Seventh embodiment | Ninth embodiment | B | No cracking/No wrinkling | A | Example |
| 96 | Fourth embodiment | Seventh embodiment | Tenth embodiment | B | No cracking/No wrinkling | A | Example |
| 97 | Fourth embodiment | Seventh embodiment | Eighth and ninth embodiments | B | No cracking/No wrinkling | A | Example |
| 98 | Fourth embodiment | Seventh embodiment | Eighth and tenth embodiments | B | No cracking/No wrinkling | A | Example |
| 99 | Fourth embodiment | Seventh embodiment | Ninth and tenth embodiments | B | No cracking/No wrinkling | A | Example |
| 100 | Fourth embodiment | Seventh embodiment | Eighth, Ninth, and tenth embodiments | B | No cracking/No wrinkling | A | Example |

TABLE 3-3

| No. | Forming method: First step | Second step | Assisting jig | | Success/failure in forming | Shape: Evaluation | Remarks |
|---|---|---|---|---|---|---|---|
| 51 | First embodiment | Eleventh embodiment | Non | B | No cracking/No wrinkling | B | Example |
| 52 | First embodiment | Eleventh embodiment | Eighth embodiment | B | No cracking/No wrinkling | A | Example |
| 53 | First embodiment | Eleventh embodiment | Ninth embodiment | B | No cracking/No wrinkling | A | Example |
| 54 | First embodiment | Eleventh embodiment | Eighth and ninth embodiments | B | No cracking/No wrinkling | A | Example |
| 55 | Second embodiment | Eleventh embodiment | Non | B | No cracking/No wrinkling | B | Example |
| 56 | Second embodiment | Eleventh embodiment | Eighth embodiment | B | No cracking/No wrinkling | A | Example |
| 57 | Second embodiment | Eleventh embodiment | Ninth embodiment | B | No cracking/No wrinkling | A | Example |
| 58 | Second embodiment | Eleventh embodiment | Eighth and ninth embodiments | B | No cracking/No wrinkling | A | Example |
| 59 | Third embodiment | Eleventh embodiment | Non | B | No cracking/No wrinkling | B | Example |
| 60 | Third embodiment | Eleventh embodiment | Eighth embodiment | B | No cracking/No wrinkling | A | Example |
| 61 | Third embodiment | Eleventh embodiment | Ninth embodiment | B | No cracking/No wrinkling | A | Example |
| 62 | Third embodiment | Eleventh embodiment | Eighth and ninth embodiments | B | No cracking/No wrinkling | A | Example |
| 63 | Fourth embodiment | Eleventh embodiment | Non | B | No cracking/No wrinkling | B | Example |
| 64 | Fourth embodiment | Eleventh embodiment | Eighth embodiment | B | No cracking/No wrinkling | A | Example |
| 65 | Fourth embodiment | Eleventh embodiment | Ninth embodiment | B | No cracking/No wrinkling | A | Example |
| 66 | Fourth embodiment | Eleventh embodiment | Eighth and ninth embodiments | B | No cracking/No wrinkling | A | Example |

REFERENCE SIGNS LIST

1 die
2 punch
5 catch portion
6 middle portion
10 blank
11 first-step formed product
12 formed product during or after second step
15 curved edge portion
16 end of curved edge portion
20 holder
21 securing block (lower)
22 securing block (upper)
23 pilot pin
24 cam slider
25 cam driver
30 circular hole
31 arc-shaped contact portion
32 holding portion
40 pressing jig
41 rise of curved edge portion
42 pressing block

43 rise at arc-shaped portion
50 portion having lager curvature
60 restrike tool (concave)
61 restrike tool (convex)
71 plate pressing pad (lower)
72 plate pressing pad (upper)
73 punch
80 push
81 rotate
110, 111, 112, 113 downward bend
120, 121, 122, 123 upward bend

The invention claimed is:

1. A method for manufacturing a metal component with a three-dimensional edge from a blank as a raw material, the blank being cut from a metal sheet and having a curved edge portion with two ends, the method comprising:

providing at least one bend formation line in the curved edge portion so that a bend radius of a section of a bent portion bent downwardly or upwardly along a curve of the curved edge portion is in the range of 0.5 to 30 mm; and after providing the bend formation line, forming the three-dimensional shape by processing the curved edge portion, and optionally by also processing the part of the blank adjacent to the curved edge portion, into the three-dimensional shape from the bend formation line by moving both ends of the curved edge portion along a horizontal plane of the curved edge portion so as to reduce or increase a distance between the two ends.

2. The method for manufacturing the metal component with a three-dimensional edge according to claim 1, wherein providing the bend formation line includes providing a flat catch portion and a middle portion, the middle portion being connected from the catch portion to both ends or an intermediate region of a portion of a main body of the blank where the at least one bend formation line is provided.

3. The method for manufacturing the metal component with a three-dimensional edge according to claim 1, wherein a plurality of bend formation lines are provided, the plurality of bend formation lines are curved lines, and a portion of at least one of the plurality of curved lines has a larger curvature than curvatures of curved portions continuous with the portion of the at least one of the plurality of curved lines on both sides of the portion.

4. The method for manufacturing the metal component with a three-dimensional edge according to claim 1, wherein forming the three-dimensional shape includes pressing a vertical wall portion that is adjacent to the curved edge portion.

5. The method for manufacturing the metal component with a three-dimensional edge according to claim 1, wherein forming the three-dimensional shape includes pressing the bend formation line as the curved edge portion is processed into the three-dimensional shape.

6. The method for manufacturing the metal component with a three-dimensional edge according to claim 1, wherein forming the three-dimensional shape includes correcting a shape of the curved edge portion while the curved edge portion is being processed into the three-dimensional shape or after the curved edge portion has been processed into the three-dimensional shape.

* * * * *